United States Patent [19]

Beneteau

[11] Patent Number: 4,580,004

[45] Date of Patent: Apr. 1, 1986

[54] COVER ASSEMBLY FOR ELECTRICAL CONNECTIONS OF A TRANSFORMER

[76] Inventor: Donald J. Beneteau, 1333 Front Rd. South, Amherstburg, Ontario, Canada

[21] Appl. No.: 531,291

[22] Filed: Sep. 12, 1983

[51] Int. Cl.[4] ..... H01F 27/04

[52] U.S. Cl. ..... 174/52 R; 336/107

[58] Field of Search ..... 336/90, 107; 174/50, 174/52 R, 59, 60; 219/116; 339/103 C, 107

[56] References Cited

U.S. PATENT DOCUMENTS 3,482,204 12/1969 Grunbaum ..... 339/107 X

FOREIGN PATENT DOCUMENTS 964695 5/1957 Fed. Rep. of Germany ..... 174/60

*Primary Examiner*—A. T. Grimley
*Assistant Examiner*—D. A. Tone
*Attorney, Agent, or Firm*—Allen D. Gutchess, Jr.

[57] ABSTRACT

A cover assembly is provided for electrical connections of a portable transformer. The cover assembly includes an inner cover plate of a size and shape to fit on an input end of the transformer. The inner cover plate has a large opening to provide easy access for connecting leads to terminal posts. An outer cover plate attaches over the portion of the inner cover plate having the large opening with the two plates having matching grooves which engage and firmly hold an outer insulating sheath for the leads. The cover assembly is compact so as to add minimal additional length to the transformer. It is also rugged and can take considerable physical abuse.

3 Claims, 2 Drawing Figures

COVER ASSEMBLY FOR ELECTRICAL CONNECTIONS OF A TRANSFORMER

This invention relates to a cover assembly for electrical connections of a transformer.

The cover assembly in accorance with the invention is particularly designed for a high amperage transformer used in resistance welding and which is portable. The transformer has an input end to which heavy electrical conductors or leads are connected through terminal posts and has an output end onto which heavy duty resistance welding electrodes are mounted.

The cover assembly includes an inner cover plate of a shape and size to fit on the input end of the transformer and to blend therewith. This cover plate has a thick portion with a large opening to provide access to the input terminal posts of the transformer. The thick portion of the inner cover plate also has a groove of generally semi-cylindrical shape in transverse cross section communicating with the access opening.

An outer cover plate has an outer contour of generally the same size and shape as the thick portion of the inner cover plate with a central recessed portion giving greater depth over the access opening. The outer cover plate also has a groove matching the groove of the inner cover plate. The grooves preferably have undulations which tightly grip and hold an insulating sheath around the heavy conductors or leads which are connected through terminal lugs to the terminal posts.

The cover assembly according to the invention adds little in length to the transformer which is significant particularly when the transformer is portable and may be moved around. The cover assembly is also extremely rugged to take abuse and withstand physical damage.

It is, therefore, a principal object of the invention to provide a cover assembly for electrical connections of a transformer having the features and advantages discussed above.

Figure 1:
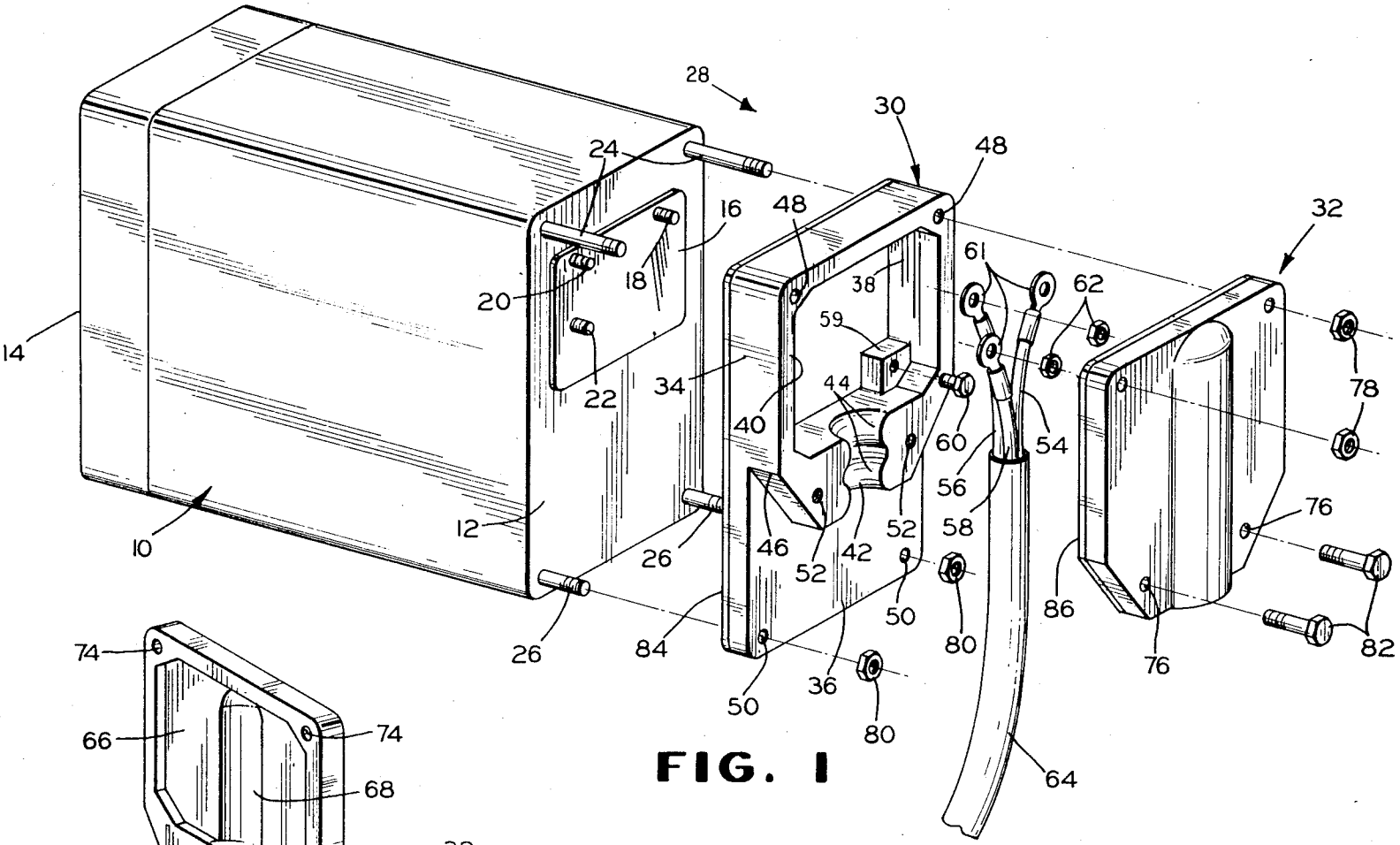
Figure 2:
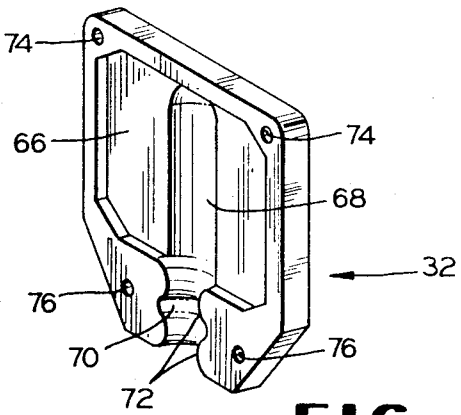

Many other objects and advantages of the invention will be apparent from the following detailed description of a preferred embodiment thereof, reference being made to the accompanying drawings, in which:

FIG. 1 is an exploded view in perspective of a transformer, cover assembly, and conductors with the cover assembly being in accordance with the invention; and FIG. 2 is a view in perspective of an outer cover plate of the cover assembly.

Referring to the drawings, and particularly to FIG. 1, a transformer embodying the invention is indicated at 10 and is in the shape of a recetangular parallelepiped. The transformer has an input end 12 and an output end 14. Heavy duty resistance welding electrodes are mounted directly on the output end 14 and in some applications these are pivotally supported so that the transformer itself pivots up and down as the electrodes open and close. The transformer also can be moved about to other welding stations when desired. The input end 12 is substantially planar with an epoxy block 16 from which terminal posts 18, 20 and 22 extend in a cluster. These can be of various designs, being shown as threaded. Upper threaded studs 24 and lower threaded studs 26 also project outwardly from the input end 12.

A cover assembly according to the invention is indicated generally at 28 and includes an inner cover plate 30 and an outer cover plate 32. The inner cover plate 30 has a thick portion 34 and a thin portion 36 with the overall cover plate being of a size and shape to fit with the input end 12 of the transformer and blend therewith. The thick portion 34 has a large access opening 38 to provide ready and easy access to the terminal posts 18–22, being of generally rectangular shape and approximately the size of the epoxy block 16. The thick portion 34 has a peripheral ridge 40 around the access opening and terminating in a planar surface. The thick portion 34 provides adequate depths around the terminal posts 18–22 and the thin portion 36 reduces the weight of the cover assembly 28. The thick portion 34 also has a groove 42 of generally semi-circular shape in transverse cross section with undulations 44 spaced therealong. The groove 42 extends to and communicates with the access opening 38 with anothe end terminating at a shoulder 46 between the thick portion 34 and the thin portion 36. The inner cover plate 30 also has two upper holes 48 through which the studs 24 extend and two lower holes 50 through which the lower studs 26 extend. Threaded or tapped bores or holes 52 are also located on each side of the groove 42 to fasten the outer cover plate 32, as will be subsequently discussed.

When the inner cover plate 30 is in place, three heavy condustors or leads 54, 56 and 58 are electrically connected to the terminal posts 18, 20 and 22. The lead 58 can be connected to the post 20 or 22 and the lead 56 connected to the common post 18. The lead 54 can be connected to an ear 59 by a grounding screw 60. Connections can be made by suitable means such as terminal lugs 61 which are received on the terminal posts and affixed by nuts 62. The leads 54–58 are encased in an insulating sheath 64 which is of a diameter slightly greater than the narrowest diameter of the groove 42 so as to be tightly received therein and held by the undulations 44.

The outer cover plate 32 is then affixed to the inner cover plate 30. The outer cover plate 32 has a central recessed portion 66 (FIG. 2) which generally matches the size and shape of the access opening 38 and provides greater depth than the thickness of the thick portion 34 along. The outer cover plate 32 also has a further recessed groove 68 in the recessed portion 66 to accommodate the insulating sheath 64. The outer cover plate also has a groove 70 which likewise has undulations 72 also engaging the insultating sheat 64 of the leads to provide a tight and waterproof connection therefor. Since the leads extend from the cover assembly at the should 46, they do not project directly beyond a side wall of the transformer which could cause interference in some applications.

The outer cover plate 32 has upper holes 74 through which ends of the studs 24 extend and lower holes 76 which are aligned with the bores 52. The upper portion of the outer cover plate 32 is affixed to the inner cover plate 30 by nuts 78 which are received on the studs 24 and clamp the inner cover plate 30 therebetween. The lower portion of the inner cover plate 30 is affixed to the input end 12 by nuts 80 which are received on the lower studs 26. Suitable machine screws 82 or the like are inserted through the lower holes 76 and threaded into the bores 52 to affix the lower portion of the outer cover plate 32 to the inner cover plate 30.

As can be seen, the cover assembly 28 adds little to the length of the transformer 10 which is important where space is a consideration. Also, the inner cover plate 30 and the outer cover plate 32 are preferably made of cast aluminum to reduce weight and yet provide a very rugged cover assembly.

For protection from water, a gasket 84 can be located between the input end 12 and the inner cover plate 30 and a gasket 86 can be located between the plate 30 and the outer cover plate 32. The plate 32 can be made for specific cable sizes with the groove 70 being of different radii.

Various modifications of the above-described embodiment of the invention will be apparent to those skilled in the art and it is to be understood that such modifications can be made without departing from the scope of the invention, if they are within the spirit and the tenor of the accompanying claims.

I claim:

1. In combination, a transformer having an input end, a plurality of terminal posts extending outwardly from said input end in a cluster, and a plurality of threaded studs extending outwardly from peripheral portions of said input end in the same direction as said terminal posts, an inner cover plate having a thick portion and a thin portion with a shoulder therebetween, said cover plate having a planar face facing said input end and said shoulder facing away from said planar face, said thick portion having an opening providing access to said terminal posts, said thick portion having a peripheral ridge around said opening and terminating in a planar surface, said thick portion of said inner cover plate having holes aligned with some of said threaded studs and said thin portion of said inner cover plate having holes aligned with other ones of said threaded studs, and said thick portion having additional holes therein, said thick portion having a groove of generally semi-circular shape in transverse cross section with one end terminating at said access opening and another end terminating at said should, an outer cover plate having an outer contour generally of the same size and shape as an outer edge of said narrow ridge and having a central recessed portion, said outer cover plate having a groove matching the groove of the inner cover plate with one end of said outer cover groove terminating at the recessed portion and another end of the outer cover groove terminating at an outer edge of said cover plate, said outer cover plate having holes aligned with the holes in the thicker portion of said inner cover plate which are aligned with said threaded studs and having additional holes aligned with the additional holes of said inner cover plate, fastener means extending through said additional holes of said outer cover plate and being threadedly received in the additional holes of said inner cover plate, and nuts threaded on said threaded studs and fastening together said inner cover plate and said outer cover plate with said input end of said transformer, when assembled.

2. The combination according to claim 1 characterized by said central recessed portion of said outer cover plate being of substantially the same size and shape as said access opening, and said central recessed portion having a further recess therein to receive electrical leads.

3. In combination, a transformer having a generally planar input end of predetermined size and shape, a plurality of terminal posts extending outwardly from said input end in a cluster, and a plurality of threaded studs extending outwardly from peripheral portions of said input end in the same direction as said terminal posts, a cover assembly comprising an inner cover plate having a thick portion and a thin portion with a shoulder therebetween, said inner cover plate being generally of the same size and shape as said input end of said transformer to form a smooth extension thereof, said thick portion having an opening providing access to said terminal posts, said thick portion having a groove of generally semi-circular shape in transverse cross section with one end terminating at said access opening and another end terminating at said shoulder, a one-piece outer cover plate having a size and shape generally similar to that of said thick portion, said outer cover plate having a groove matching the groove of the inner cover plate, a plurality of heavy conductors electrically connected to said terminal posts and having an insulating sheath therearound, a portion of said insulating sheath being tightly held in said grooves when said inner and outer cover plates are assembled, said inner and outer cover plates having holes aligned with some of said threaded studs and said inner cover plate having additional holes aligned with additional ones of said threaded studs, and additional means affixing a portion of said outer cover plate to said inner cover plate.

* * * * *

UNITED STATES PATENT OFFICE

CERTIFICATE OF CORRECTION

PATENT NO. : 4,580,004

DATED : April 1, 1986

INVENTOR(S) : Donald J. Beneteau

It is certified that error appears in the above-identified patent and that said Letters Patent are hereby corrected as shown below:

Column 2, line 14, "anothe" should be --another--.

Column 2, line 41, "along" should be --alone--.

Column 2, line 44, "sheat" should be --sheath--.

Column 2, line 47, "should" should be --shoulder--.

Claim 1, line 21, "should," should be --shoulder,--.

Signed and Sealed this

*Twenty-ninth* Day of *July 1986*

[SEAL]

*Attest:*

DONALD J. QUIGG

*Attesting Officer*

*Commissioner of Patents and Trademarks*